US009032862B2

(12) United States Patent
Yong et al.

(10) Patent No.: US 9,032,862 B2
(45) Date of Patent: May 19, 2015

(54) ROTATING CYLINDER

(75) Inventors: Jian-Hua Yong, Shenzhen (CN); Wen-Tao Wang, Shenzhen (CN); Rui Xia, Shenzhen (CN)

(73) Assignee: JI ZHUN PRECISION INDUSTRY (HUI ZHOU) CO., LTD., Huizhou (CN)

( * ) Notice: Subject to any disclaimer, the term of this patent is extended or adjusted under 35 U.S.C. 154(b) by 371 days.

(21) Appl. No.: 13/596,285

(22) Filed: Aug. 28, 2012

(65) Prior Publication Data

US 2013/0118345 A1 May 16, 2013

(30) Foreign Application Priority Data

Nov. 16, 2011 (CN) ..... 201110363419

(51) Int. Cl.
*F01B 21/00* (2006.01)
*F15B 15/06* (2006.01)

(52) U.S. Cl.
CPC ..... *F15B 15/063* (2013.01); *F15B 15/068* (2013.01)

(58) Field of Classification Search
CPC ..... F15B 15/063; F15B 15/068
USPC ..... 92/2, 31, 32, 33
See application file for complete search history.

(56) References Cited

U.S. PATENT DOCUMENTS 4,508,327 A * 4/1985 Ersoy ..... 92/33
5,778,511 A * 7/1998 Keaton ..... 29/559
7,111,834 B2 * 9/2006 Steele et al. ..... 92/2

FOREIGN PATENT DOCUMENTS

TW M414519 U1 10/2011

* cited by examiner

*Primary Examiner* — Michael Leslie
(74) *Attorney, Agent, or Firm* — Novak Druce Connolly Bove + Quigg LLP

(57) ABSTRACT

A rotating cylinder includes a cylinder body, a piston, a piston shaft assembly, a main body and a guiding assembly. The cylinder body defines a receiving chamber. The piston, the piston shaft assembly, the main body and the guiding assembly are received in the receiving chamber. The piston shaft assembly is fixed to the piston, and defines at least one guiding groove lengthwise thereof. Each guiding groove includes a spiral portion and an extending portion. The main shaft is non-rotatably connected to the piston shaft assembly away from the piston and exposed out of the cylinder body. The guiding assembly sleeves on the piston shaft assembly and is slidably connected with the at least one guiding groove. The main shaft is driven to rotate when the guiding assembly engages the spiral portion, and move lengthwise when the guiding assembly is slidably connected with the extending portion.

20 Claims, 3 Drawing Sheets

ROTATING CYLINDER

BACKGROUND

1. Technical Field

The present disclosure generally relates to cylinders, and particularly to a rotating cylinder.

2. Description of Related Art

Cylinders are used for holding and conveying workpieces during industrial manufacturing processes, or applying torque to other devices or mechanisms as a driver. The cylinder may include a cylinder body defining a receiving chamber, a piston and a piston shaft. The cylinder body may define openings at opposite ends thereof communicating with the receiving chamber. The piston may be movably received in the receiving chamber; a first end of the piston shaft may be fixed to the piston, and a second end of the piston shaft may be extended out of the cylinder body via one opening. A pressing rod is positioned in the second end of the piston shaft to clamp or transfer materials. The pressing rod is driven to rotate and move linearly at the same time. The pressing stroke of the pressing rod equals the length of the piston shaft. However, the volume of the cylinder may be relatively large, and this requires more setup space.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
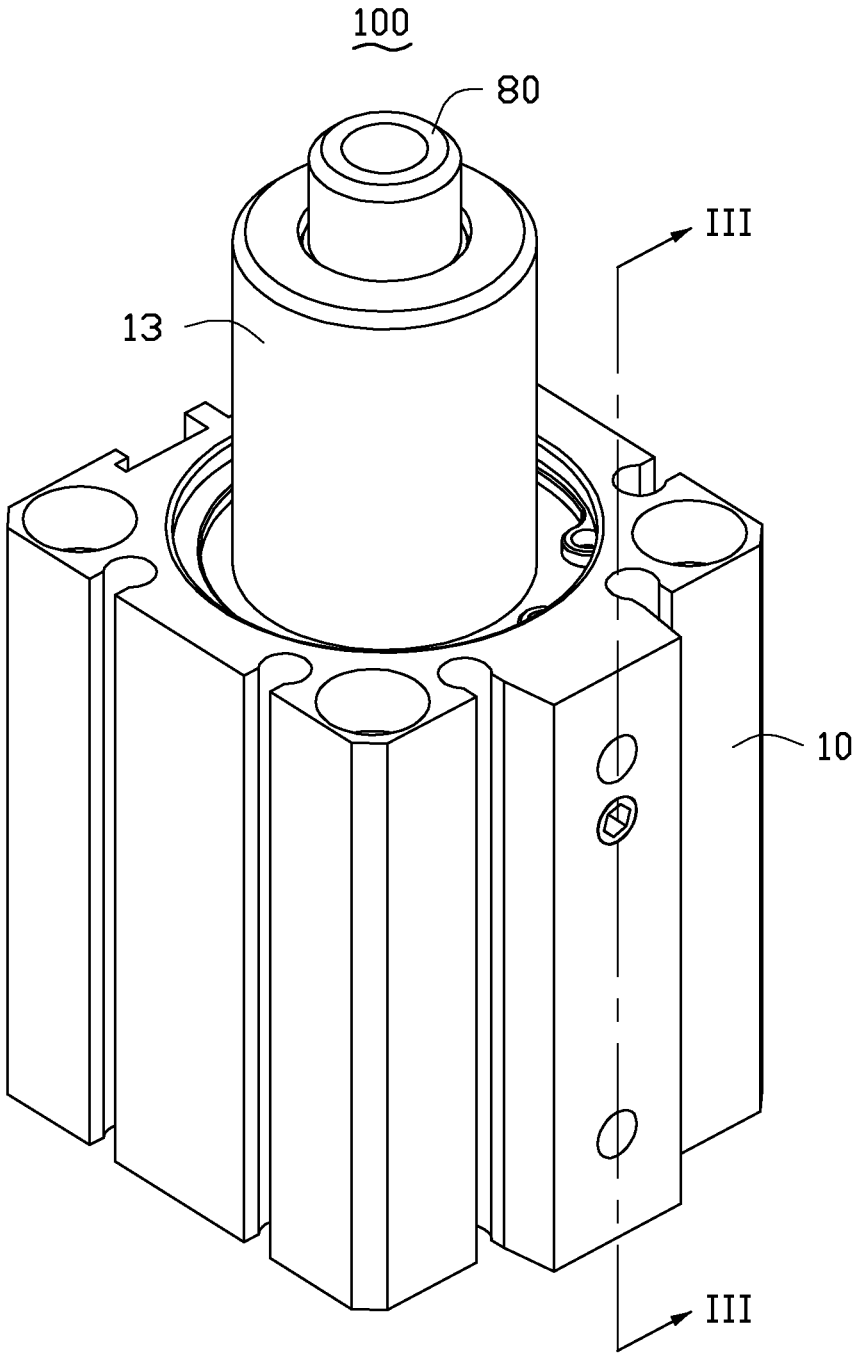
FIG. 1 shows an isometric view of an embodiment of a rotating cylinder.
Figure 2:
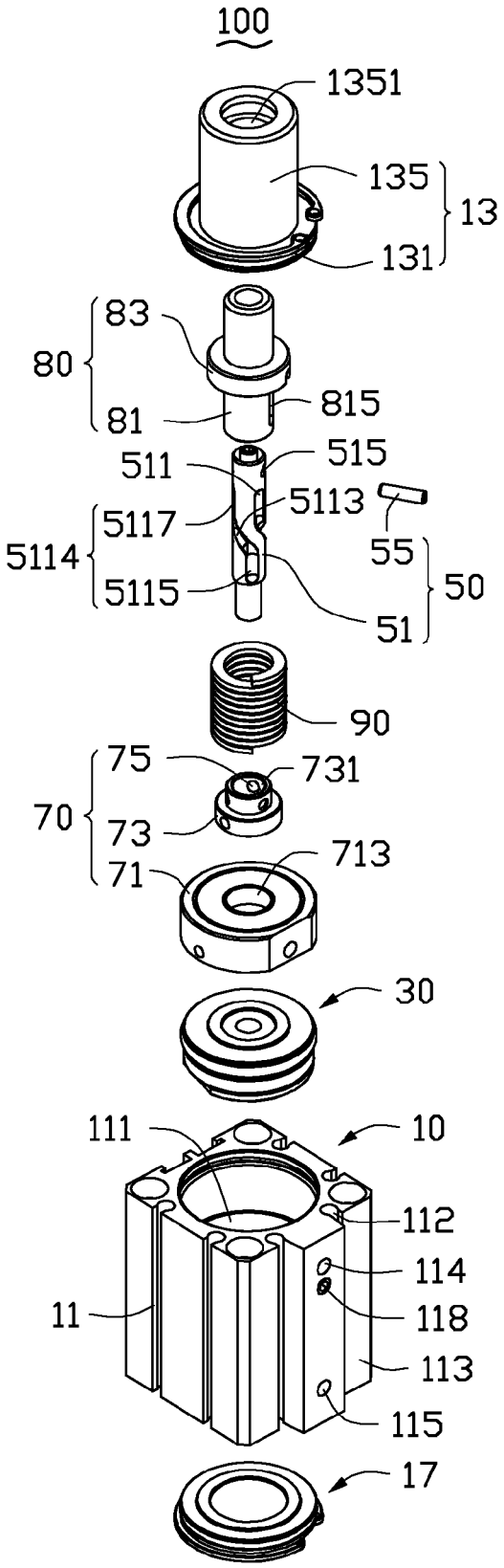
FIG. 2 shows an exploded isometric view of the rotating cylinder of FIG. 1.
Figure 3:
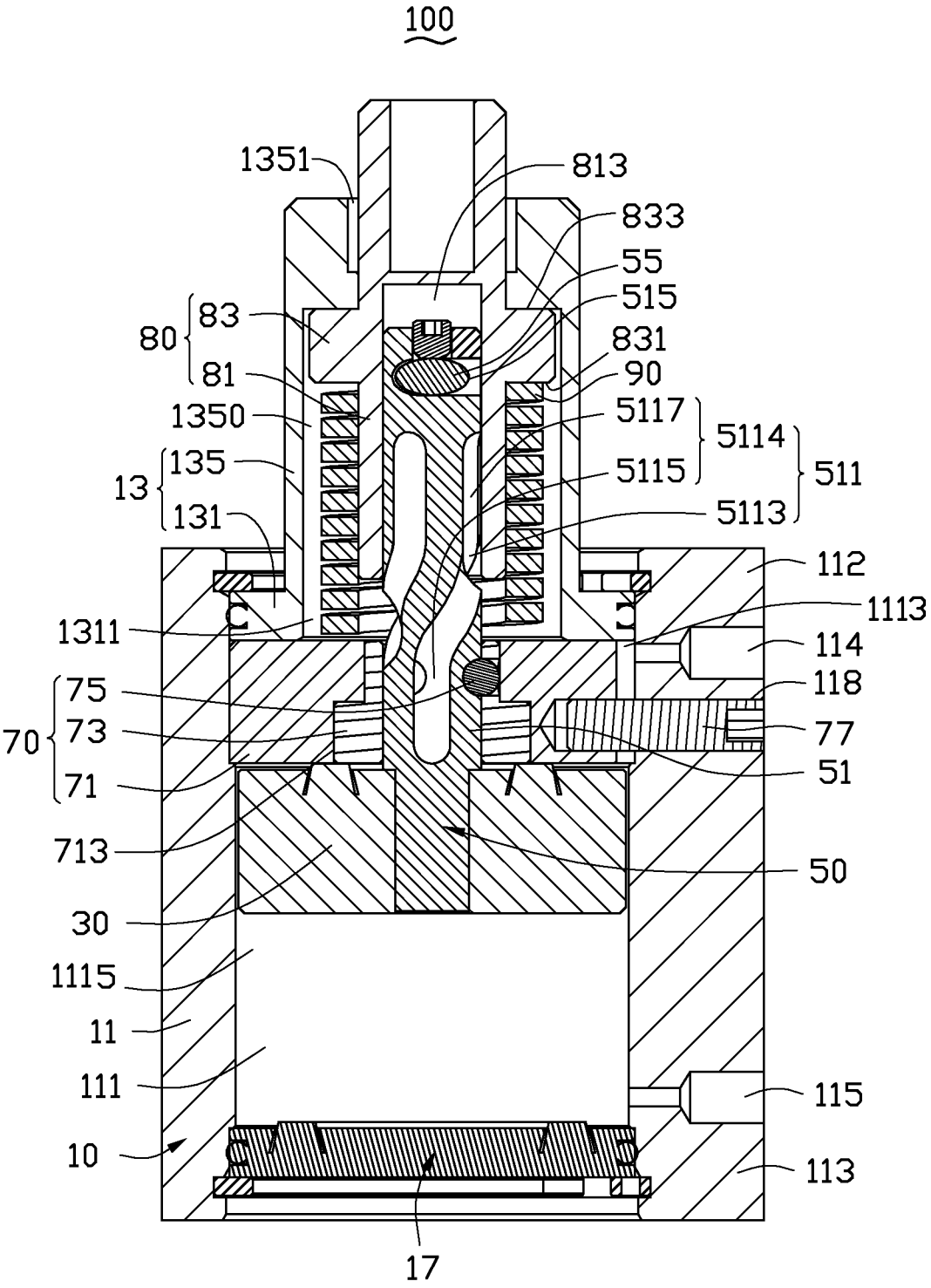
FIG. 3 is a cross section of the rotating cylinder of FIG. 1, taken along line

Referring to FIG. 1 through 3, an embodiment of a rotating cylinder 100 is shown. The rotating cylinder 100 includes a cylinder body 10, a piston 30, a piston shaft assembly 50, a guiding assembly 70, a main shaft 80 and an elastic member 90. The piston 30, the piston shaft assembly 50, and the guiding assembly 70 are received in the cylinder body 10. The piston 30 is fixed to the piston shaft assembly 50 at one end of the piston shaft assembly 50. The guiding assembly 70 sleeves on a middle portion of the piston shaft assembly 50 and is fixedly connected to the cylinder body 10. One distal end of the main shaft 80 is non-rotatably connected to the piston shaft assembly 50 away from the piston 30, and another distal end of the main shaft 80 is exposed out of the cylinder body 10 for mounting a pressing rod (not shown) to clamp or convey workpieces. The elastic member 90 sleeves on the main shaft 80. The main shaft 80 may be driven to rotate and move linearly together with the piston shaft assembly 50.

The cylinder body 10 includes a cylinder barrel 11, a head cover 13 and a bottom cover 17. The cylinder barrel 11 defines a receiving chamber 111 axially, for assembling the piston 30, the piston shaft assembly 50, the guiding assembly 70 and the main shaft 80. The cylinder barrel 11 includes a head end 112 and a bottom end 113 opposite to the head end 112. The first vent 114 is defined through the sidewall of the cylinder barrel 11 adjacent to the head end 112. The second vent 115 is defined through the sidewall of the cylinder barrel 11 adjacent to the bottom end 113. A fastening hole 118 is formed at the cylinder barrel 11, and positioned between the first vent 114 and the second vent 115.

The head cover 13 is hermetically engaged in the head end 112 of the cylinder barrel 11. The head cover 13 includes a clamping portion 131 and a mounting portion 135 connected with the clamping portion 131. The clamping portion 131 is hermetically assembled within the head end 112, and the mounting portion 135 is exposed out of the cylinder barrel 11. A first mounting hole 1311 is defined through along a center of the clamping portion 131. A second mounting hole 1350 communicating with the first mounting hole 1311 is formed at one distal end of the mounting portion 135 adjacent to the clamping portion 131 and an insertion hole 1351 is defined at another distal end of the mounting portion 135. The first mounting hole 1311 is coaxial with the second mounting hole 1350 and the insertion hole 1351. The insertion hole 1351 also communicates with the second mounting hole 1350, and is of a width which is less than that of the second mounting hole 1350. The bottom cover 17 is hermetically engaged in the bottom end 113.

The piston 30 is movably and hermetically received in the receiving chamber 111. That is, the receiving chamber 111 is divided into a first chamber 1113 and a second chamber 1115 by the piston 30. The first chamber 1113 and the second chamber 1115 are isolated from each other. The first chamber 1113 is positioned adjacent to the head end 112 and communicates with the first vent 114; the second chamber 1115 communicates with the second vent 115.

The piston shaft assembly 50 includes a piston shaft 51 and a first guiding member 55 positioned at the piston shaft 51. The piston shaft 51 is fixed to the piston 30 at one distal end. Three guiding grooves 511 are recessed from an outer peripheral wall of the piston shaft 51, and spaced from each other. Each guiding groove 511 includes a spiral portion 5113 and an extending portion 5114 extending from the spiral portion 5113 and communicating with the spiral portion 5113. In the illustrated embodiment, the extending portion 5114 includes a first extending segment 5115 and a second extending segment 5117. The first extending segment 5115 and the second extending segment 5117 extend from opposite ends of the spiral portion 5113 along an axial direction of the piston shaft 51. In another embodiment, the arrangement and the number of the spiral portions 5113 and the extending portions 5114 can be designed according to the actual demands or needs. L1, L2, and L3 represent the vertical lengths of the spiral portion 5113, of the first extending segments 5115 and of the second extending segments 5117 along the axial direction of the piston shaft 51, respectively. A length of the guiding groove 511 along the axial direction of the piston shaft 51 is L which equals the sum of the distances L1, L2 and L3.

An installation hole 515 is defined at the sidewall of the piston shaft 50 away from the piston 30. The first guiding member 55 passes through the installation hole 515. Two ends of the first guiding member 55 are exposed out of the installation hole 515. In the illustrated embodiment, the first guiding member 55 is a pin. In one embodiment, a plurality of protrusions formed on the peripheral wall of the piston shaft 51 may replace the first guiding members 55, and the number of the first guiding members 55 may be two or more.

The guiding assembly 70 includes a fixing member 71, an installation element 73, a second guiding member 75 and a fastener 77. The fixing member 71 is a substantially round plate, and is positioned in the cylinder barrel 11 adjacent to the head end 112. A through hole 713 is defined through the fixing member 71. The installation element 73 is a hollow structure, and is positioned in the through hole 713. Three second guiding members 75 are rotatably positioned on an inner wall of the installation element 73 for engaging with the three guiding grooves 511. The piston shaft 51 passes through the installation element 73, such that each second guiding member 75 can engage with one guiding groove 511. In the illustrated embodiment, the second guiding members 75 are a plurality of ball bearings or rolling balls. In other embodiments, the second guiding members 75 may be a plurality of protrusions formed on the inner sidewall of the installation element 73.

The main shaft 80 sleeves on the distal end of the piston shaft 51 away from the piston 30, and passes through the head cover 13 to be exposed out of the head cover 13 via the insertion hole 1351. The fixing member 71 is positioned between the main shaft 80 and the piston 30. The main shaft 80 includes a main body 81 and a resisting flange 83 formed on the main body 81. The main body 81 is substantially cylindrical. A receiving hole 813 is formed at one end of the main body 81. The distal end of the piston shaft 51 away from the piston 30 is received in the receiving hole 813. Two diametrically-opposite sliding grooves 815 are formed on a peripheral wall of the main body 81 along an axial direction of the main shaft 80 and positioned adjacent to the receiving hole 813. The two ends of the first guiding member 55 slidably engage with the two sliding grooves 815. A length of the sliding groove 815 is less than the axial length of the guiding groove 511. In the illustrated embodiment, the length of the sliding groove 815 is equal to the sum of the distances L1 and L2. Another distal end of the main shaft 80 opposite to the receiving hole 813 is exposed out of the head cover 13 for mounting the pressing rod.

The resisting flange 83 is formed on a middle portion of the peripheral wall of the main body 81 along the radial direction of the main body 81. The resisting flange 83 includes a first resisting surface 831 and a second resisting surface 833. The first resisting surface 831 faces toward the fixing member 71, and the second resisting surface 833 resists against a bottom of the receiving hole 813.

The elastic member 90 sleeves on the main body 81, and resists between the first resisting surface 831 and the fixing member 71 for helping the main shaft 80 to return to its original position. The elastic member 90 is also received in the second mounting hole 1350 together with the main body 81. In the illustrated embodiment, the elastic member 90 is a spring.

Also referring to FIGS. 2 and 3, when assembling the cylinder 100, the bottom cover 17 is firstly hermetically assembled with the bottom end 113. Then the piston 30 is fixed to the piston shaft assembly 50. The piston 30 and the piston shaft 51 are put into the receiving chamber 111. The guiding assembly 70 is sleeved on the piston shaft 51, and the second guiding members 75 are slidably connected within the guiding grooves 511. The fastener 77 is inserted into the fastening hole 118 to fixedly connect the fixing member 71 to the cylinder barrel 11. The elastic member 90 is sleeved on the main body 81. The main shaft 80 sleeves on the piston shaft 51, and the two ends of the first guiding member 55 are slidably positioned in the two sliding grooves 815. The head cover 13 is sleeved on the main shaft 80 via the second mounting hole 1350 and hermetically covers the head end 112, the main body 81 being exposed out of the head cover 13. The elastic member 90 resists between the first resisting surface 831 and the fixing member 71.

In use, pressurized gas is allowed into the first chamber 1113 by means of the first vent 114. A certain amount of pressure of the gas will force the piston shaft 51 to slide toward the bottom cover 17. Meanwhile, the piston shaft 51 is carried by the piston 30 to move toward the bottom cover 17, thereby sliding the first guiding member 55 along the sliding grooves 815, and the second guiding members 75 are firstly engaged with the first extending segments 5115. The piston shaft 51 is thus forced to rotate in the receiving chamber 111 when the second guiding member 75 reaches the spiral portion 5113 during the linear motion. At the same time, the main shaft 80 is brought to rotate by the piston shaft 51. In the illustrated embodiment, the main shaft 80 rotates in a plane.

The piston shaft 51 together with the main shaft 80 ceases to rotate when the second guiding members 75 begin to slide along the second extending segment 5117. Meanwhile, the first guiding member 55 reaches an end of the sliding groove 815 away from the resisting flange 83. The main shaft 80 is driven to move axially by the piston shaft 51 toward the fixing member 71 until the first guiding member 55 arrives at ends of the sliding grooves 815 adjacent to the resisting flange 83. The elastic member 90 is thus compressed. A pressing stroke of the piston shaft 51 in the cylinder body 10 is equal to L which is the axial length of the guiding groove 511. A pressing stroke of the main shaft 80 is the summation of the distances L1 and L2. During the pressing stroke, the main shaft 80 rotates at first, and then moves towards the bottom cover 17.

Pressurized gas is allowed into the second chamber 1115 by the means of the second vent 115, and the gas pressure is decreased in the first chamber 1113 via the first vent 114 at the same time, resulting in a backward stroke of the piston shaft 51. The piston 30 is driven to move toward the fixing member 71 when the gas pressure in the second chamber 1115 is high enough. Meanwhile, the piston shaft 51 is forced to move longitudinally by the piston 30, and the main shaft 80 is driven to return to its original position by the elastic member 90. The first guiding member 55 slides along the sliding groove 815 and the second guiding members 75 slides along the second extending segment 5117. The second guiding members 75 finally arrives at the end of the sliding groove 815 adjacent to the resisting flange 83, and the main shaft 80 returns to its original position. After that, the piston shaft 51 is driven to rotate around the axis of the piston shaft 51 together with the main shaft 80 by the movement of the second guiding members 75 in the spiral portion 5113. The piston shaft 51 and the main shaft 80 cease rotating when the second guiding members 75 arrive at the first extending segment 5115. During the backward stroke, the main shaft 80 at first moves towards the head cover 13 and finally rotates after the axial movement. An ascending stroke of the main shaft 80 is the summation of the distances L1 and L2.

The rotating cylinder 100 has a very simple arrangement or configuration. The guiding grooves 511 including the spiral portion 5113, the first and the second extending segments 5115 and 5117 are recessed on the peripheral wall of the piston shaft 51. The second guiding members 75 are capable of sliding along the sliding grooves 815 for guiding the movement of the piston shaft 51. The main shaft 80 is non-rotatably connected to the piston shaft 51. The rotating cylinder 100 can both rotate and move linearly independently under simple control. The linear distance of the movement of the main shaft 80 is less than a length of the sliding groove 511. A significant amount of working space will be saved by the rotating cylinder 100.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A rotating cylinder, comprising:

a cylinder body defining a receiving chamber;

a piston movably received in the receiving chamber;

a piston shaft assembly movably received in the receiving chamber, connected with the piston at one distal end, and defining at least one guiding groove lengthwise thereof;

each guiding groove comprising a spiral portion and an extending portion extending from the spiral portion and communicating with the spiral portion, the spiral portion positioned adjacent to the piston;

a main shaft non-rotatably connected to the piston shaft assembly away from the piston and exposed out of the cylinder body;

a guiding assembly sleeving on the piston shaft assembly, slidably connected with the at least one guiding groove and positioned between the main shaft and the piston;

wherein the main shaft is driven to rotate around an axis of the piston shaft when the guiding assembly slidably engages with the spiral portion, and to move lengthwise thereof when the guiding assembly is slidably connected with the extending portion.

2. The rotating cylinder of claim 1, wherein the main shaft comprises a main body defining axially at least one sliding groove, the piston shaft assembly comprises a piston shaft and a first guiding member, the piston is fixedly connected with the piston shaft at one distal end, the guiding assembly sleeves on the piston shaft, the first guiding member is positioned at the piston shaft at another end away from the piston, the first guiding member slidably engages with the at least one sliding groove.

3. The rotating cylinder of claim 2, wherein a length of each sliding groove is less than a length of each guiding groove along the axial direction of the piston shaft.

4. The rotating cylinder of claim 3, wherein an extending portion comprises a first extending segment and a second extending segment extending from opposite ends of the spiral portion, and the first extending segment is positioned adjacent to the piston.

5. The rotating cylinder of claim 2, wherein the guiding assembly comprises an installation element and at least one second guiding member, the installation element sleeves on the piston shaft and is fixed within the cylinder body, the at least one second guiding member is positioned on an inner wall of the installation element and slidably engages with the at least one guiding grooves.

6. The rotating cylinder of claim 5, wherein the at least one second guiding member is rotatably positioned on the inner wall of the installation element.

7. The rotating cylinder of claim 5 further comprising a fixing member fixedly sleeving on the installation element, the fixing member is fixedly connected within the cylinder body.

8. The rotating cylinder of claim 2, wherein the main shaft further comprises a resisting flange formed on a peripheral wall of the main body, the rotating cylinder further comprises an elastic member being sleeved on the main body, and resisting between the resisting flange and the guiding assembly.

9. The rotating cylinder of claim 2, wherein the cylinder body comprises a cylinder barrel defining the receiving chamber, and a head cover, the head cover comprises a clamping portion and a mounting portion connected with the clamping portion, the clamping portion engaged at one end of the cylinder barrel, the mounting portion extends out of the cylinder barrel.

10. The rotating cylinder of claim 9, wherein the clamping portion defines a receiving hole, a mounting hole is formed in the mounting portion communicating with the receiving hole, the main shaft passes through the receiving hole and the mounting hole.

11. A rotating cylinder, comprising:

a cylinder body defining a receiving chamber;

a piston movably received in the receiving chamber;

a piston shaft assembly comprising a piston shaft and a first guiding member; the piston shaft movably received in the receiving chamber, connected with the piston at one distal end, and defining at least one guiding groove along an axial direction thereof; each guiding groove comprising a spiral portion and an extending portion communicating with the spiral portion, the spiral portion positioned adjacent to the piston, the first guiding member positioned at the piston shaft away from the piston;

a main shaft non-rotatably connected to the piston shaft away from the piston, and exposed out of the cylinder body; the main shaft defining at least one sliding groove slidably engaged with the first guiding member;

a guiding assembly sleeving on the piston shaft, slidably connected with the at least one guiding groove and positioned between the main shaft and the piston; wherein the main shaft is driven to rotate around an axis of the piston shaft when the guiding assembly slidably engages with the spiral portion, and to move lengthwise thereof when the guiding assembly is slidably connected with the extending portion.

12. The rotating cylinder of claim 1, wherein the main shaft comprise a main body, the at least one sliding groove is defined on peripheral wall of the main body along an axial direction of the main shaft.

13. The rotating cylinder of claim 12, wherein a length of each sliding groove is less than a length of each guiding groove along the axial direction of the piston shaft.

14. The rotating cylinder of claim 13, wherein an extending portion comprises a first extending segment and a second extending segment extending from opposite ends of the spiral portion, and the first extending segment is positioned adjacent to the piston.

15. The rotating cylinder of claim 11, wherein the guiding assembly comprises an installation element and at least one second guiding member, the installation element sleeves on the piston shaft and is fixed within the cylinder body, the at least one second guiding member is positioned on an inner wall of the installation element and slidably engages with the at least one guiding grooves.

16. The rotating cylinder of claim 15, wherein the at least one second guiding member is rotatably positioned on the inner wall of the installation element.

17. The rotating cylinder of claim 15, further comprising a fixing member fixedly sleeving on the installation element, the fixing member is fixedly connected to the cylinder body.

18. The rotating cylinder of claim 11, wherein the rotating cylinder further comprises an elastic member, the main shaft further comprises a resisting flange formed on a peripheral wall of the main body; the elastic member sleeves on the main body, resisting between the resisting flange and the guiding assembly.

19. The rotating cylinder of claim 11, wherein the cylinder body comprises a cylinder barrel defining the receiving chamber, and a head cover, the head cover comprises a clamping portion and a mounting portion connected with the clamping portion, the clamping portion is positioned at one end of the cylinder barrel, the mounting portion extends out of the cylinder barrel.

20. The rotating cylinder of claim 19, wherein the clamping portion defines a receiving hole, a mounting hole is formed in the mounting portion communicating with the receiving hole, the main shaft passes through the receiving hole and the mounting hole.

* * * * *